United States Patent [19]

Side

[11] Patent Number: 4,835,919

[45] Date of Patent: Jun. 6, 1989

[54] IMPERVIOUS SHELTER MADE OF MODULES

[75] Inventor: Solly Side, Arnouville les Gonesse, France

[73] Assignee: Societe Gerac, Toulouse, France

[21] Appl. No.: 116,052

[22] Filed: Nov. 2, 1987

[30] Foreign Application Priority Data

Nov. 4, 1986 [FR] France ..... 86 15327

[51] Int. Cl.[4] ..... E04H 9/02; E04H 9/04

[52] U.S. Cl. ..... 52/79.9; 52/167; 52/169.6; 52/79.11; 285/230; 138/145

[58] Field of Search ..... 285/288, 230, 285, 286; 405/135, 147, 136; 138/145, 153, 175; 52/224, 79.9, 79.11, 167, 169.6

[56] References Cited

U.S. PATENT DOCUMENTS

| | | | |
|---|---|---|---|
| 1,346,687 | 7/1920 | Scofield | 138/153 |
| 1,424,586 | 8/1922 | Page | 285/288 |
| 2,232,656 | 2/1941 | Davis | 285/286 |
| 3,111,811 | 11/1963 | Eggink et al. | 138/153 |

FOREIGN PATENT DOCUMENTS 898867 5/1984 France .

OTHER PUBLICATIONS

Civil Engineering, Jan. 1982, pp. 11–13, Londres, GB; "Rubber Bearings on Thames Barrier".

*Primary Examiner*—James L. Ridgill, Jr.
*Attorney, Agent, or Firm*—Oblon, Fisher, Spivak, McClelland & Maier

[57] ABSTRACT

An impervious shelter is made of tube-shaped modules fitted end to end. The invention pertains more especially to the junction between the facing ends of the modules. Each module has an outer shell covered on the inside by a metal sheet. At the facing ends of two modules, the metal sheets are prolonged by collars which fit into one another. At least one of the collars has a grooved and flexible part which can change shape without breaking when the shelter is subjected to external stresses.

3 Claims, 1 Drawing Sheet

IMPERVIOUS SHELTER MADE OF MODULES

BACKGROUND OF THE INVENTION

1. Field of the Invention

The present invention pertains to an impervious shelter made of modules that are placed end to end and communicate with one another.

2. Description of the Prior Art

Prior art shelters of this type have modules in the form of tubes connected end to end. The word "tube" is used in a broad sense to include rectilinear or curved conduits, regardless of their cross section. Each module generally has an outer shell made of reinforced concrete and a solid shell made of sheet metal which covers the inner wall of the concrete shell nearly up to the ends of this concrete shell. The shell made of sheet metal can have its inside lined with a concrete or a cement cover, generally not reinforced and thinner than the outer shell. To make the shelter impervious, the modules have metallic collars at their ends. The collars prolong the shells made of sheet metal. The word "collar" is used in a broad sense which applies even to collars with non-circular sections. These collars are welded on one side to the end of the sheet-metal shell which they prolong and are slightly conical on the opposite side. This conical shape is either a flaring out or a shrinking of the collar. Thus, by associating two collars of these two types together, they can be made to enter each other and provide imperviousness either by means of a seal or through welding. In other examples, the paths of the collars designed to be fitted into one another have substantially constant but different diameters, and the joint is made impervious either by a seal or by welding.

When the collars are welded, the imperviousness of these connections between modules is efficient as regards not only gas, liquids and dust but also electromagnetic waves. However, these connections stand up poorly to the mechanical stresses caused, for example, by earth tremors. These connections then tend to break and thus cause a loss of imperviousness.

SUMMARY OF THE INVENTION

An object of the present invention is to remove this disadvantage, or at least to reduce its significance.

This result is obtained, especially, by using collars which are grooved and flexible on an intermediate part of their length.

According to the present invention, there is provided an impervious shelter made of tube-shaped modules, wherein each module has two ends and at least one thick and resistent outer shell with an inner wall and two ends, and a shell made of solid sheet metal covering the inner wall of the outer shell nearly up to the ends of said outer shell, wherein the modules are connected, two by two, at their ends with the two facing ends of two connected modules each comprising, for this purpose, a metal collar which prolongs the shell made of sheet metal and is joined to it, the collars of the two facing ends being joined to each other, wherein, whatever the construction may be the two module ends facing each other, at least one of the two collars corresponding to the two facing ends considered has a part which is grooved and flexible along an intermediate portion of its length.

BRIEF DESCRIPTION OF THE DRAWING

Various other objects, features and attendant advantages of the present invention will be more fully appreciated as the same becomes better understood from the following detailed description when considered in connection with the accompanying drawings in which like references characters designate like or corresponding parts throughout the several views and wherein.

DESCRIPTION OF THE PREFERRED EMBODIMENT

Figure 1:
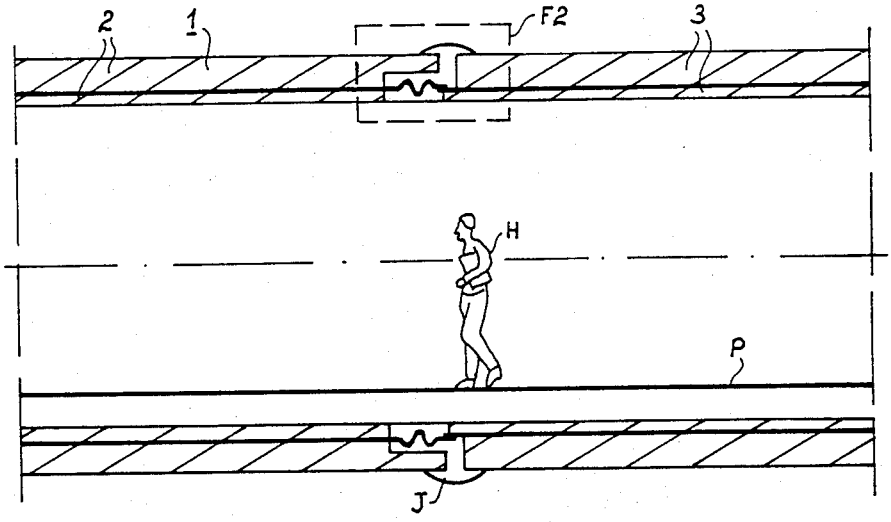
FIG. 1 is a partial view of a shelter according to the invention.

FIG. 1 shows a section of a shelter 1 seen in longitudinal section. This section is built with two modules 2, 3 using tubes with an external diameter of about 4 meters, attached end to end by a ring-shaped connection device J. A rectangular box F2, drawn with dashes, surrounds a part of the shelter located at the junction between the modules 2 and 3. This part, depicted in greater detail in FIG. 2, shows how the walls of the modules are made and how the connection device J provides imperviousness inside the shelter.

FIG. 1 also shows the floor P of the shelter 1 and a person H, standing up, who will be the reference to appreciate the size of the shelter.

Figure 2:
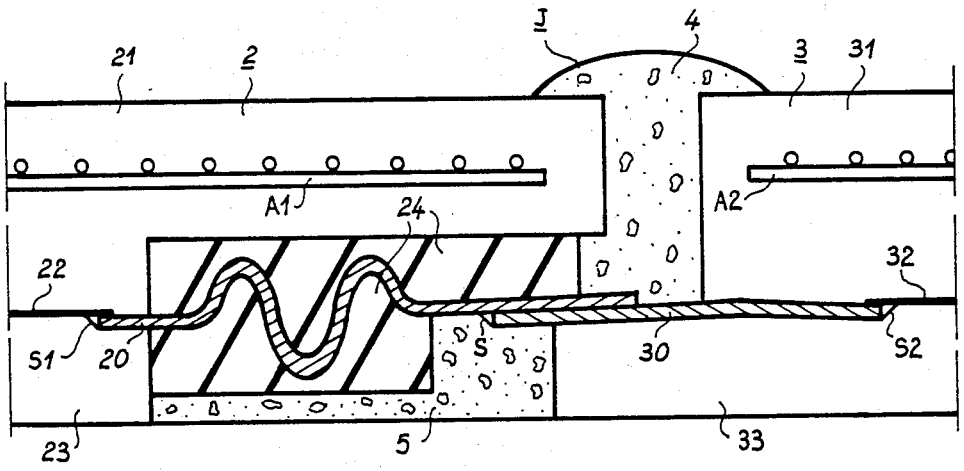
FIG. 2 is a more detailed view of a part of the shelter according to FIG. 1.

FIG. 2 is a view, enlarged about six times, of the part of the diagram of FIG. 1 surrounded by the rectangle F2.

FIG. 2 shows that, outside the zone of their junction, the walls of the modules 2 and 3 are made up of three superimposed shells 21, 22, 23 and 31, 32, 33. The outer shell 21, 31 is a thick layer of concrete associated with a solid reinforcement A1, A2. The shell 22, 32 consists of a solid metal sheet and the inner shell 23, 33 is made of concrete. In the junction zone between the modules, the metal sheet is replaced by a metal collar which is appreciably thicker than the metal sheet. This collar is welded to the metal sheet which it prolongs: the collar 20 is joined to the sheet metal of the shell 22 by the weld S1, and the collar 30 is joined to the sheet metal of the shell 22 by the weld S2. The collar 30, which is a conventional type of collar, fits, at its end opposite to the solid sheet-metal shell 32, into the end of the collar 20 opposite to the solid sheet-metal shell 22. A weld S joins the two collars at the end of the collar 30 opposite to the solid sheet-metal shell 32.

Unlike the collar 30, the collar 20 is not a conventional type of collar. Between its part welded to the metal sheet 22 and its part fitted into the collar 30, the collar 20 has a grooved and flexible intermediate part made up of three sinusoidal arches. To make place for these sinusoidal arches, the thickness of the shell 21 is reduced by about a third along its internal part, a little before the sinusoidal arches up to its end facing the module 3, and the inner shell 23 is eliminated slightly before the sinusoidal arches. The space between the collar 20 and the thinned part of the shell 22 is filled with a flexible, bitumen-based material 24, which also covers the inner surface of the collar 20 from the inner shell 23 up to and including the three sinusoidal arches. This material has two roles: the first is that it contributes to making the connection impervious to gases, fluids and dust and it makes it possible for the grooved part of the collar 20 to change shape under the effect of external stresses so as to prevent it breaking, as would be the case if it has been buried in concrete. Since the spaces 4 and 5 remain unoccupied after the two modules are fitted into each other and after the weld S is made, they are filled with concrete.

The present invention is not limited to the example described. Thus, in particular, the two collars relating to the two facing ends of two modules placed end to end may each comprise an intermediate grooved part. Thus, again, the outer shell 21 (FIG. 2) can be stopped substantially at the same level as the inner shell 23 but a greater mass of concrete should be added in order to protect the collar. Again, the collars can be assembled by any suitable method of assembly, in particularly by crimping, and the grooved and flexible part may be surrounded with a flexible material, or it may be lined only on one side, preferably the external side, with a flexible material. In this latter case, an unoccupied space should be left around this grooved part, and the concrete should not come into contact with it or too close to it so that it can change shape without breaking under the effect of external stresses. Finally, the grooved part may have a number, other than three, of arcs, and these arcs may be other than sinusoidal arches.

The present invention pertains, in particular, to nuclear, chemical and bacteriological shelters for personnel and equipment.

Obviously, numerous modifications and variations of the present invention are possible in light of the above teachings. It is therefore to be understood that within the scope of the appended claims, the invention may be practiced otherwise than as specifically described herein.

What is claimed is:

1. An impervious shelter made of tube-shaped modules, wherein each module has two ends and comprises at least one thick and resistent outer shell with an inner wall and two ends, and a shell made of solid sheet metal covering the inner wall of the outer shell nearly up to the ends of said outer shell, wherein the modules define at their ends a space which separates completely two facing ends of two connected modules, at each of the two facing ends of two connected modules a metal collar is provided extending from said outer shell and which comprises solid sheet metal, said metal collars of the two facing ends are joined to each other and at least one of the two collars corresponding to the two facing ends comprises a part which is grooved and flexible along an intermediate portion of its length and wherein the grooved and flexible part is lined, at least externally, with a thick layer of a flexible material arranged in said space and said space is closed, at least externally, with concrete.

2. A shelter according to claim 1 wherein the grooved and flexible parts are surrounded by the outer shell.

3. A shelter according to claim 2 wherein, at each module end, the outer shell of the considered module has a recess in its inner wall for positioning the grooved and flexible part of the collar.

* * * * *